United States Patent [19]

Young

[11] Patent Number: 5,012,748

[45] Date of Patent: May 7, 1991

[54] SLEIGHROAD

[76] Inventor: Timothy T. J. Young, 656 Lytton Ave., Apt. B421, Palo Alto, Calif. 94301

[21] Appl. No.: 319,700

[22] Filed: Mar. 6, 1989

[51] Int. Cl.[5] ..... A63G 21/00

[52] U.S. Cl. ..... 104/134; 104/307; 104/242; 105/26.05; 105/1.4

[58] Field of Search ..... 104/134, 119, 135, 136, 104/281, 287, 288, 165, 242, 247, 307; 105/1.4, 26.05, 32, 96, 98, 100, 3, 102, 31, 101, 34.1, 49, 157.1, 181, 182.1

[56] References Cited

U.S. PATENT DOCUMENTS

| | | | |
|---|---|---|---|
| 2,186,355 | 1/1940 | Wilson | 105/98 X |
| 3,678,860 | 7/1972 | Veldhuizen | 104/134 X |
| 3,841,223 | 10/1974 | Bertin | 104/134 X |
| 3,858,521 | 1/1975 | Atherton | 104/286 X |
| 3,926,128 | 12/1975 | Zappel | 105/101 X |
| 4,274,338 | 6/1981 | Vozumi | 104/119 X |
| 4,307,668 | 12/1981 | Vinson | 104/281 |
| 4,503,778 | 3/1985 | Wilson | 104/119 X |
| 4,550,663 | 11/1985 | DeViaris | 104/119 |

*Primary Examiner*—Douglas C. Butler

[57] ABSTRACT

A sleighroad is disclosed including a wheelless transportation system with a locomotive including motorized horsehoofing thrusters for propelling a plurality of carriages equipped with ball thrust bearings for running on steel rails instead of using conventional carriage wheels and wherein the carriages include side-mounted roller thrust bearings operatively connected to side guard railings to keep the carriages on track.

1 Claim, 3 Drawing Sheets

SLEIGHROAD

There may be keen competition between Sleighroad and Maglev (magnetic levitation) which has been in development for more than 10 years. Maglev has the advantage of running levitated though for the start of a run small wheels are used; and it would be a problem to operate a train with a multiple number of carriages.

Sleighroad, a wheelless fast surface transportation system is a system of devices in daily use, integrated into a working whole. The instant invention includes a horsehoofing thruster, which may be said to be not new in that horses use them from creation. Then again with dynamics added, it is expected that the hoofing device should give satisfactory service.

Sleighroad, as different from railroad, is a thoroughbred wheelless fast surface transportation system, consisting of carriages with undercarriages equipped with ball thrust bearings for running on steel flat rails, and propelled by an innovated motorized horsehoofing thruster, which verily is the sleighroad engine.

The sleighroad way consists of cast steel clad girders with stress-relieved reinforced concrete beams for the core, and with its up side sufficing rails; and of cast steel clad guard/guide railings with reinforced concrete rods for the core, and the railings fixtured on the wire fences on both sides.

Carriages and equipments are manufactured with space age aluminum thermos bonded metals for light weight.

The sleighroad system has load points distributed on the balls of the ball thrust bearings, thus lessening friction area, and the sleighroad is driven by horsehoofing thruster in thrusts instead of by traction.

The sleighroad is a unique system in that (1) it requires only conventional manufacturing processes and is easily adapted to mass production, (2) it being light for wheelless transit, there is no need for heavy mechanical and civil engineering, a great saving in cost and in lead time. Suitable motors for motive power are now available in many superb makes, and thrust bearings and the horsehoofing thrusters, and the cast steel clad girders and railings, all new things for sleighroad system can readily be mass produced.

Figure 1:
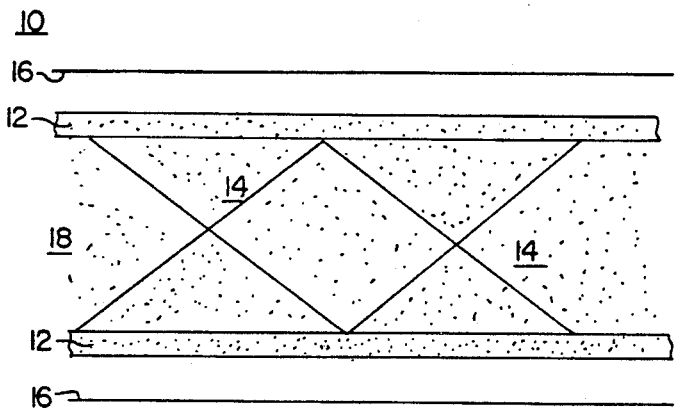
FIG. 1. 10 is the sleighroad ground plan
FIG. 1A. Cross section of Girder/rail
FIG. 2. Elevation of the wire fence
FIG. 2-A. Cross section of guard/guide railing
FIG. 3. Side elevation of sleigh carriage
FIG. 4. The sleigh brake
FIG. 5. side elevation of locomotive
FIG. 6. ball thrust bearing
FIG. 6-A. ball thrust bearing-race
FIG. 7. roller thrust bearing
FIG. 8. side view of horsehoofing thruster
FIG. 8-A. horsehoofing thruster—cut-away view
FIG. 8-B. outer curve of shoe with dynamics Shown in FIG. 1 is the ground plan of the sleighroad way 10, with girders/rails 12 laid parallel above ground, tied by angle irons 14 to make a 5-foot gauge track, and wire fences erected on the sides and steel plates 18 laid on the ties 14 to make the floor.
Figure 1A:
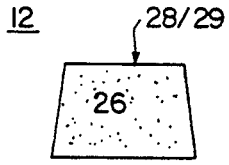

The girder/rail 12 is shown in cross-section in FIG. 1-A, beam 26 of reinforced concrete as core and cast steel clad 28 of outside dimensions 9"×7"×11", and the 9" wide up side sufficing rail 29.

Figure 2:
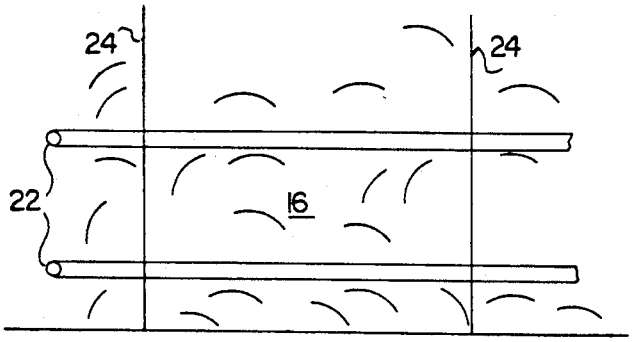
Figure 2A:
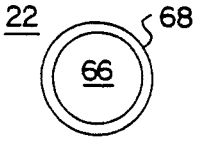

Wire fence shown in elevation in FIG. 2 has guard/-guide railings 22 fixtured on posts 24 for keeping the carriages on track. A railing 22 is shown its cross-section in FIG. 2-A with rod 66 of reinforced concrete as core, and cast steel clad 68.

Figure 3:
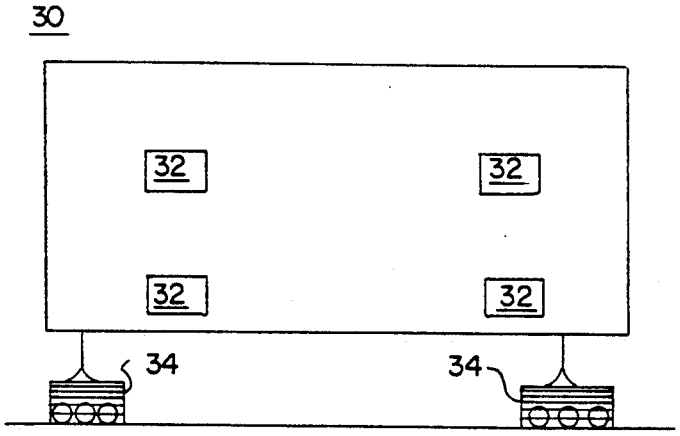

The carriage 30 is shown its side elevation in FIG. 3 with roller thrust bearings 32 fixed on its sides to run on railings 22, to keep it on track. On the undercarriage are installed ball thrust bearings 34 for running on the rails 28/29.

Figure 4:
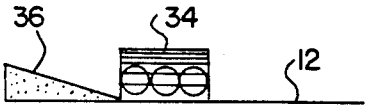

The brake 36 is a wedge as shown in FIG. 4 about to be shimmed between ball thrust bearings 34 and rail 28/29 in girder 12.

Figure 6:
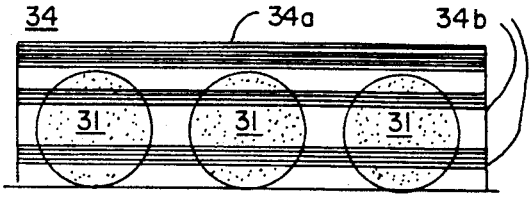
Figure 6A:
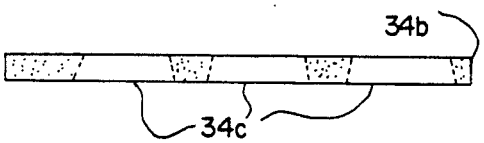

The ball bearings 34 shown in FIG. 6 consists of the top piece **34*a* and the two identical race pieces 34*b* positioned in symmetry and with the bearing balls 31 in the grooves 34*c*. The top piece 34*a* is made a heavy piece to take the vertical load on the balls. These ball thrust bearings 34** take the place of conventional carriage wheels.

Figure 5:
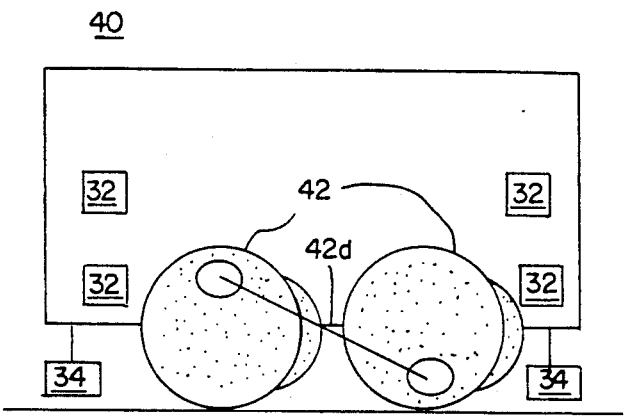

The locomotive 40 is shown its side elevation in FIG. 5 with the undercarriage similar to that described of carriage 30, and the two horsehoofing thrusters 42 are shown disposed in tandem and connected by rod **42*d*** for sync.

Figure 7:
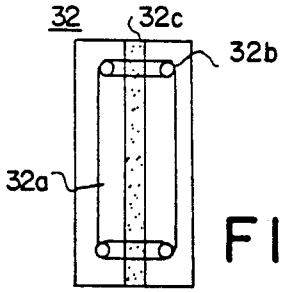

The roller thrust bearing 32 in FIG. 7 has a roller **32*a* tight-fitted at both ends with ball bearings 32*b* that revolves on shaft 32*c*. These roller thrust bearings 32 fitted on the sides of the carriage run on the railings 22**.

Figure 8:
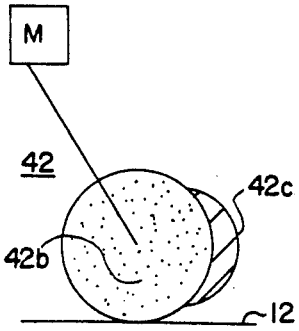
Figure 8B:
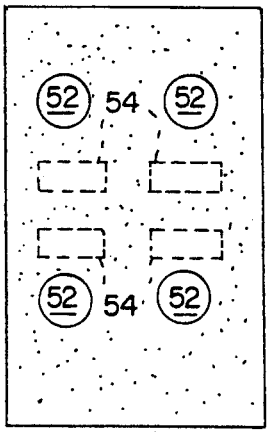
Figure 8A:
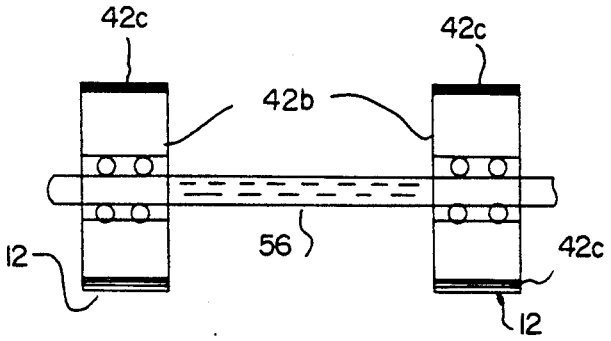

Horeshoofing thrusters 42 is shown its side view in FIG. 8, with drum **42*b*, shoe 42*c*. In FIG. 8-A a cut away view, the thruster is shown the drum 42*b*, one fitted and pivoting on each end of axle tree 56 for hoofing on the rails 28/29 in track 12. This axle tree 56** carries no vertical load.

FIG. 8-A shows the shoe **42*c*, of flexible material such as natural rubber or plastic, with suction cups 52 (FIG. 8-B) created on its outer curve surface, and magnetic pieces 54** embedded in it, both the suction cups and magnetic pieces being for dynamics.

The horsehoofing thrusters 42 are to be operated invariably in gang of more than one thruster, disposed in tandem, and for working in sync, as shown in FIG. 5, to keep the vehicle driven by them from see-sawing.

I claim:

1. A sleighroad of the wheelless surface transportation type comprising carriages (30) with undercarriages equipped with ball thrust bearings (34) for running on steel tracks or rails (12,28,29) wherein the plurality of carriages (30) are propelled by a single locomotive (40), the locomotive (40) including motorized horsehoofing thruster means (42), the track (12,28,29) being made of cast steel clad rails, each rail or track (12,28,29) having a reinforced concrete beam as the core, sheet metal laid on angle irons (14) connecting the rails to form a floor and with the upper side of the rail (12,28,29) sufficing as the support rail, wire fences on both sides of the arrangement to which are connected cast steel clad guard or guide railings (22), each guard or railing having a reinforced concrete rod as the core for keeping said carriages on the track or rails (12,28,29), the locomotive (40) including an undercarriage equipped with ball bearings (34) of the thrust bearing type for running on the rails or tracks (28,29) and wherein said thruster means (42) includes a plurality of such motorized thrusters (42) disposed in tandem relationship to work in synchronization to keep the locomotive (40) and carriages (30) from see-sawing, each thruster means (42) comprising a drum (42*b*) and crescent-shaped shoe (42*c*) for the hoof and comprising suction cups (52) and magnetic pieces (54) for dynamic stability, the shoe (42*c*) made of flexible material such as rubber or plastic with said magnetic pieces (54) embedded in the shoe (42*c*), wherein the tandem thruster means (42) include a common rod (42*d*) connecting at least some of the thruster means (42), wherein the ball thrust bearings (34) take the place of conventional carriage wheels, said guard or guide railings (22) operatively connect to said carriages (30) and said locomotive (40) by way of roller thrust bearings (22) fixed on the respective sides of said carriages (30) and on the sides of the locomotive (40) for lateral or transverse stability.

* * * * *